US011619003B2

(12) United States Patent
Poikolainen

(10) Patent No.: US 11,619,003 B2
(45) Date of Patent: Apr. 4, 2023

(54) SLEEVE ROLL BELT IN FIBER WEB MACHINE

(71) Applicant: Valmet Technologies Oy, Espoo (FI)

(72) Inventor: Antii Poikolainen, Jyväskylä (FI)

(73) Assignee: VALMET TECHNOLOGIES OY, Espoo (FI)

( * ) Notice: Subject to any disclaimer, the term of this patent is extended or adjusted under 35 U.S.C. 154(b) by 0 days.

(21) Appl. No.: 17/324,930

(22) Filed: May 19, 2021

(65) Prior Publication Data

US 2021/0363697 A1 Nov. 25, 2021
US 2022/0275579 A9 Sep. 1, 2022

(30) Foreign Application Priority Data

May 20, 2020 (EP) ..... 20175590

(51) Int. Cl.
*D21F 3/02* (2006.01)

(52) U.S. Cl.
CPC ..... *D21F 3/0227* (2013.01)

(58) Field of Classification Search
CPC ..... D21F 3/0227; D21F 1/40; D21F 1/0036; D21F 3/0236; B29D 29/00; D02G 3/047; D02G 3/44
See application file for complete search history.

(56) References Cited

U.S. PATENT DOCUMENTS 4,787,946 A 11/1988 Romanski
5,062,924 A * 11/1991 McCarten ..... D21F 3/0227 428/167
5,134,010 A * 7/1992 Schiel ..... D21F 3/0236 428/397

FOREIGN PATENT DOCUMENTS

EP 1382738 A1 * 1/2004 ..... B29C 67/246
EP 1382738 A1 1/2004
WO 2018097777 A1 5/2018

OTHER PUBLICATIONS

Extended European Search Report for EP 20175590 dated Nov. 3, 2020.

* cited by examiner

*Primary Examiner* — Eric Hug
*Assistant Examiner* — Matthew M Eslami
(74) *Attorney, Agent, or Firm* — Stiennon & Stiennon

(57) ABSTRACT

A belt (10) for a sleeve roll forms a closed loop and has an inner surface (11) and an outer surface (12). The belt has an elastic body (15) with an outer surface (15*a*) and a reinforcing structure (30). The reinforcing structure has first yarns (31*a*) arranged to a first direction (D1), and second yarns (32*a*) arranged to a second direction (D2). The second yarns (32*a*) are arranged, at least partially, on the elastic body (15), and/or the second yarns (32*a*) are arranged to a depth of equal to or less than 2 mm, measured from the outer surface (15*a*) of the elastic body to a bottom (32*a-i*) of the second yarn (32*a*) in a depth direction of the belt. The invention further relates to a use of a belt. The invention further relates to an arrangement comprising a belt and a sleeve roll.

19 Claims, 4 Drawing Sheets

SLEEVE ROLL BELT IN FIBER WEB MACHINE

CROSS REFERENCES TO RELATED APPLICATIONS

This application claims priority on EP20175590 filed May 20, 2020, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

This invention relates to a belt for a sleeve roll. This invention relates to an arrangement comprising a belt and a sleeve roll.

Paper machines, as well as board, pulp, and tissue machines, are typically equipped with a forming section, a press section, and a drying section. In paper, pulp and board making, it is an issue how to increase the dewatering amount from a wet fiber web in order to improve production efficiency.

Nowadays, these machines typically have belts and wires to remove water from the fiber web. Water can be removed e.g. on the forming section through at least one forming wire.

A sleeve roll can be used e.g. in the forming section to improve dewatering from the web. The sleeve roll must have a sleeve roll belt. However, it has been challenging to obtain a belt able to perform well with sleeve rolls.

SUMMARY OF THE INVENTION

The present invention discloses a novel belt for a sleeve roll. A novel arrangement comprises a belt and a sleeve roll.

The object of the present invention is to provide an improved belt for a sleeve roll. The belt has an outer surface for engaging a fiber web, and an inner surface surrounding and facing the sleeve roll such that portions of the sleeve roll engage the inner surface of the belt. The sleeve belt has a belt body of a selected thickness between the inner surface and the outer surface. The sleeve belt is reinforced by first and second yarns. The first yarns are arranged in a first direction preferably parallel or substantially parallel to the cross machine direction of the belt and are typically located near the middle of the belt thickness. The second yarns are arranged in a second direction preferably in a machine direction parallel or substantially parallel to the travel direction of the belt and the second yarns are located on or near the outer surface of the belt. The first and second yarns making up the reinforcing of the belt are arranged perpendicular or nearly perpendicular to each other. The second yarns are arranged, at least partially, on the outer surface of the belt body, and/or each second yarn is arranged to a depth equal to or less than 2 mm, measured from the outer surface of the elastic belt body to a bottom of the second yarn in a depth direction of the belt. The number of the second yarns is from 140 yarns/m to 620 yarns/m, and/or the number of the first yarns is from 140 yarns/m to 620 yarns/m. The yarns can be formed of more than 5 filaments per yarn, more preferably equal to or more than 200 filaments per yarn, and most preferably equal to or more than 500 filaments per yarn. Further yarns may have equal to or less than 10,000 filaments per yarn, more preferably equal to or less than 4,000 filaments per yarn, and most preferably equal to or less than 2,000 filaments per yarn.

The sleeve roll is typically located at a wire section of a paper, board, pulp or tissue machine. Thanks to the sleeve roll, moisture removal of the wire section can be improved.

The novel belt, also referred as a sleeve roll belt herein, is suitable for a sleeve roll of a paper, board, pulp or tissue machine. The structure of the sleeve roll having a curve element on its outer surface differs from a structure of a shoe press, hence, properties needed for a sleeve roll belt differ from properties needed for a shoe press belt. For example, shoe press belts must be able to handle stresses caused by the long nip of the shoe press. The long nip of the shoe press causes high stresses to the shoe press belt due to the sharp deflections upon an entrance into and emergence from the pressing zone. The sleeve roll does not have said long nip; hence, the sleeve roll belt does not need to handle those kind of stresses. However, the sleeve roll belt must have suitable properties to handle different stresses caused by the curve element of the sleeve roll. Belts used for shoe presses have not been able to perform properly with sleeve rolls. Thus, there has been a need for an improved belt suitable for a sleeve roll.

The belt for a sleeve roll comprises an inner surface and an outer surface. The belt can form a closed loop and comprises: an elastic body and a reinforcing structure.
The reinforcing structure can be a support structure supporting the elastic body.

The reinforcing structure can comprise first yarns forming a first yarn layer. The reinforcing structure can further comprise second yarns forming a second yarn layer. The second yarn layer can be the outermost yarn layer closest to the outer surface of the belt.

The first yarns are arranged to a first direction, and the second yarns are arranged to a second direction. The second direction is preferably perpendicular or substantially perpendicular to the first direction. The second direction can further be parallel or substantially parallel to a travel direction of the belt. Further, the first direction can be parallel or substantially parallel to an axis of rotation of the belt.

The second yarns of the second yarn layer can be arranged, at least partially, on the elastic body of the belt. Therefore, the second yarns can be at least partially visible to a human eye. Thus, in this case, the second yarns are not fully surrounded by the material of the elastic body, but they may be partially surrounded by the material of the elastic body. The technical effect is that the neutral axis can be near the outer surface of the belt. This can significantly reduce wear of the belt and provide a longer life for the belt. Furthermore, the second yarns can form grooves between adjacent yarns. Thus, water removal rate can be improved.

In addition, or alternatively, the second yarns can be arranged at least partially into the elastic body. Thus, in this advantageous example, the yarns may be at least partially surrounded by the material of the elastic body. Thus, the neutral axis can be near the outer surface of the belt. This can reduce wear of the belt and provide a longer life than prior belts.

Therefore, the second yarns can be arranged to a depth of equal to or less than 2 mm, measured from an outer surface of the elastic body to a bottom of the second yarn in the depth direction of the belt. Thus, the yarns of the second yarn layer can be arranged on the elastic body, or partially or fully into the elastic body. Thus, the yarns may be partially or fully surrounded by the material of the elastic body.

Advantageously, the second yarns are arranged to a depth of equal to or less than 1.5 mm, more preferably equal to or less than 1.0 mm or equal to or less than 0.8 mm, and most preferably equal to or less than 0.5 mm, measured from the outer surface of the elastic body to the bottom of each second yarn in the depth direction of the belt. The technical effect is to arrange the neutral axis of the belt so that wear of the belt can be reduced, which can result in a longer life of the belt compared to other belts.

The number of first yarns used in the belt can be in a range between 100 yarns/m and 650 yarns/m, preferably from 140 yarns/m to 600 yarns/m. Further, the number of the second yarns can be in a range between 100 yarns/m and 650 yarns/m, preferably from 140 yarns/m to 600 yarns/m. Therefore, the belt can have good stretching and strength properties for the sleeve roll.

The first yarns may have the same, or substantially same diameter as the second yarns. In an embodiment, the second yarns have a smaller diameter, e.g. at least 10% smaller diameter than the first yarns. If a diameter of the yarns in the second yarn layer is smaller than a diameter of the yarns in the first yarn layer, the second yarns may be more flexible than the first yarns.

A diameter of the first yarns can be from 0.5 mm to 10.0 mm. The diameter of the first yarns can be equal to or less than 5 mm, more preferably equal to or less than 2 mm, and most preferably equal to or less than 1.5 mm. Thus, it is possible to obtain a thin sleeve roll belt. Further, the diameter of the yarns in the first yarn layer can be equal to or more than 0.6 mm, more preferably equal to or more than 0.8 mm and most preferably equal to or more than 1.0 mm. Thus, the sleeve roll belt can be attached firmly on the sleeve roll.

A diameter of the second yarns can be from 0.5 mm to 10.0 mm. The diameter of the yarns in the second yarn layer can be equal to or less than 5 mm, more preferably equal to or less than 2 mm, and most preferably equal to or less than 1.5 mm. Thus, the sleeve roll belt may have yarns arranged near the outer surface of the belt, and/or on the elastic body, which yarns may be able to form grooves on the surface of the belt. Further, the diameter of the yarns in the second yarn layer can be equal to or more than 0.6 mm, more preferably equal to or more than 1.0 mm and most preferably equal to or more than 1.3 mm. Thus, it is possible to obtain good strength properties for the belt. Further, the yarns may form grooves on the surface of the belt.

The first yarn layer is preferably the innermost yarn layer, closest to the inner surface of the sleeve roll belt. Thus, the first yarns are preferably arranged closest to the inner surface of the belt. These yarns can be embedded in the elastic body. The first yarns are preferably fully surrounded by the material of the elastic body, i.e., the material of the elastic body can surround the yarns on all sides.

The second yarn layer is preferably the outermost yarn layer, closest to the outer surface of the sleeve roll belt. Thus, the second yarns arranged to the second direction are preferably arranged on the outer surface of the elastic body, and/or closest to the outer surface of the belt. The second yarns may be selected so that they have better wear resistance than the first yarns.

The second yarns may be bonded to the first yarns. In this embodiment, the first yarns and the second yarns are arranged on the outer surface of the elastic body and/or near the outer surface of the elastic body. The first yarns bonded to the second yarns may improve strength properties of the reinforcing structure.

The second yarns can form grooves on the outer surface of the belt. Thus, it is possible to obtain improved water removal rate. Further, because the grooves can be formed by the second yarns, there is no need for grooves formed by the material of the elastic body. Thus, the grooves formed by the elastic body material may not harm the yarns.

The depth of the groove, formed by the adjacent second yarns, can be more than 0 mm and preferably equal to or less than 2.0 mm, such as in a range between 0.3 mm and 1.5 mm.

In this application, the term "elasticity" refers to an ability of the belt to return to its original shape when a force is removed. Elasticity percentages (%) are values stating how much the belt can stretch elastically. The novel sleeve roll belt may be configured to stretch elastically equal to or more than 1.5% in the travel direction of the sleeve roll belt so that it will return in its original length after the force stretching the belt has been removed. Further, the sleeve roll belt can be configured to stretch elastically equal to or more than 1.8%, such as from 2.0% to at least 3%, in the travel direction of the sleeve roll belt so that it will return in its original length after the force stretching the belt has been removed.

Elasticity of the first yarns may be smaller, e.g. at least 10% smaller, than elasticity of the second yarns. Thus, the novel sleeve roll belt may be configured to stretch elastically at least 10% more in the second direction than to the first direction. In an embodiment, the elasticity of the first yarns is at least 20% smaller than the elasticity of the second yarns.

A load at specific elongation (LASE) refers to the load needed for the determined elongation, i.e., load applied for a specified elongation. For example, LASE 2% is a value defined as a load when the elongation is 2%. It is determined based on the standard SFS 2983. The values can be determined by using Alwetron TCT 20 device from Lorentzen & Wettre AB (Lorentzen & Wettre, Sweden).

In an embodiment, a load at specific elongation of 2% (LASE 2%) in the travel direction of the sleeve roll belt can be equal to or more than 28 kN/m and preferably equal to or less than 40 kN/m. Further, in the embodiment, a load at specific elongation of 4% (LASE 4%) in the travel direction of the sleeve roll belt can be equal to or more than 49 kN/m and preferably equal to or less than 60 kN/m. This may provide good properties for the sleeve roll belt.

In an embodiment, the sleeve roll belt may be configured to stretch with a force of 30 kN/m in the travel direction of the sleeve roll belt so that it will return in its original length after the force stretching the belt has been removed. Thus, the belt may have improved stretchability and elasticity in the travel direction of the belt. This may be particularly suitable for sleeve rolls due to a curve element therein.

The sleeve roll belt can have a breaking strength equal to or more than 100 kN/m, such as from 170 kN/m to 230 kN/m, determined in the travel direction of the sleeve roll belt. The technical effect is that the belt can perform well with heavy stresses. The breaking strength can be determined based on the standard SFS 2983. The values can be determined by using Alwetron TCT 20 device from Lorentzen & Wettre AB (Lorentzen & Wettre, Sweden).

Thanks to the novel solution, an improved belt suitable for a sleeve roll can be obtained. The novel sleeve roll belt can have a novel reinforcing structure. Further, the novel sleeve roll belt can have the neutral axis near the outer surface of the belt. Therefore, wear of the belt may be reduced. Furthermore, wear of a wire in contact with the belt may be reduced.

BRIEF DESCRIPTION OF THE DRAWINGS

In the following, the invention will be illustrated by drawings.

FIGS. 2*b*-4*b* illustrate examples of internal structures of the belt of the invention.

The figures are illustrations which may not be in scale. Similar parts are indicated in the figures by the same reference numbers.

DESCRIPTION OF THE PREFERRED EMBODIMENTS

Figure 1A:
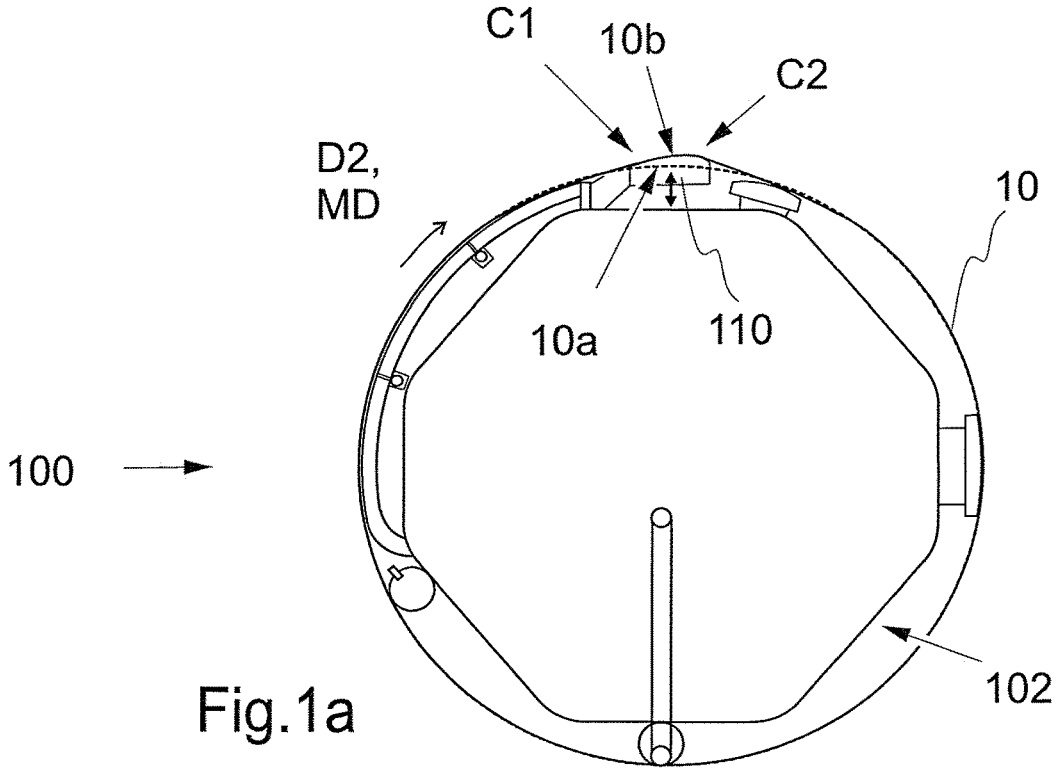
FIGS. 1*a-b* illustrate examples of a sleeve roll used with the belt of the invention.

All embodiments in this application are presented as illustrative examples, and they should not be considered limiting. The following reference numerals are used in this application:

10 belt,
11 inner surface of the belt,
12 outer surface of the belt,
15 elastic body,
15*a* outer surface of the elastic body,
30 reinforcing structure,
31 first yarn layer of the reinforcing structure,
31*a* first yarn(s), forming the first yarn layer,
32 second yarn layer of the reinforcing structure,
32*a* second yarn(s), forming the second yarn layer,
32*a-i* bottom of the second yarn in the depth direction of the belt, i.e., innermost surface of the second yarn,
50 grooves on the outer surface of the belt,
60 attaching point of the sleeve roll belt,
D1 first direction of the belt,
D2 second direction of the belt,
MD travel direction of the belt,
CD cross direction of the belt,
100 sleeve roll,
102 support shaft of the sleeve roll,
110 curve element of the sleeve roll,
10*a* a surface at a first position of the movable curve element,
10*b* a surface at a second position of the movable curve element,
T1 depth measured from the outer surface of the elastic body to the
bottom of the second yarn in the depth direction of the belt,
C1 first curve of the sleeve roll, and
C2 second curve of the sleeve roll.

The sleeve roll belt 10 can be an impermeable belt. The sleeve roll belt refers to a belt which is suitable for a sleeve roll.

In this application, the term "yarn" refers to a long structure, which has relatively small cross section. The yarn can be composed of fibers and/or filaments, with or without twist. The yarn can be multiple plied yarn. The yarn can be based on synthetic polymer(s).

The term "filament" refers to a fiber of great length.

The terms "first yarn layer" and "first yarns" refer to yarns which are arranged in a first direction. The first yarn layer may be the innermost yarn layer. The first yarns may be arranged in the cross direction of the sleeve roll belt.

The terms "second yarn layer" and "second yarns" refer to yarns which are arranged in a second direction. The second yarns may be arranged in the travel direction of the sleeve roll belt. The second yarn layer may be the outermost yarn layer.

Therefore, the term "first yarns" refers to yarns of the first yarn layer and the term "second yarns" refers to yarns of the second yarn layer. The belt can comprise the first yarn layer and a second yarn layer. Thus, the sleeve roll belt can have several yarns arranged in at least two direction.

The first yarn layer can consist of separate yarns. Thus, the adjacent yarns of the first yarn layer can be spaced from each other.

Further, the second yarn layer can consist of separate yarns. Thus, the adjacent yarns of the second yarn layer can be spaced from each other.

In this application, the terms "travel direction" MD and "cross direction" CD are used. The travel direction MD refers to the direction of rotation of the sleeve roll belt in use. The cross-direction CD refers to the longitudinal direction transverse to the travel direction MD of the belt 10. In use, the cross-direction is parallel to the axis of rotation of the sleeve roll belt.

In this application, the term "substantially parallel" means that one direction does not deviate from said substantially parallel direction by more than 15 degrees, more advantageously not by more than 10 degrees, and most preferably not by more than 5 degrees. Thus, e.g. "substantially parallel to the travel direction" means, in this application, that a direction does not deviate from said travel direction by more than 15 degrees, more advantageously not by more than 10 degrees, and preferably not by more than 5 degrees. Furthermore, e.g. "substantially parallel to the cross-direction" means, in this application, that a direction does not deviate from said cross-direction by more than 10 degrees, more advantageously not by more than 5 degrees, and preferably not by more than 3 degrees.

In this application, the term "first direction" D1 refers to a direction to which the first yarns are arranged. The first direction is preferably parallel or substantially parallel to the cross direction of the belt. Further, the term "second direction" D2 refers to a direction to which the second yarns are arranged. The second direction is preferably parallel or substantially parallel to the travel direction of the belt.

However, in an embodiment, the first direction has an angle in a range between 10° and 25° to the cross direction of the belt and/or the second direction has an angle in a range between 10° and 25° to the travel direction of the belt.

Furthermore, the term thickness of the belt will be used, referring to the depth direction of the sleeve roll belt.

Typically, in paper, board, pulp and tissue machines, the fiber web is produced and treated in an assembly formed by several apparatuses arranged consecutively in a process line. A typical production line comprises a forming section comprising a headbox and a wire, a press section, a drying section and, finally, a reel-up. Further, the production line typically comprises e.g. at least one winder for forming customer rolls.

In the forming section, a headbox is used to form the fiber web. Further, some water can be removed through at least one forming wire. The sleeve roll 100 can be located in the forming section for improving water removal therein. The present invention relates to a sleeve roll belt 10 for a sleeve roll 100. The sleeve roll 100 can be located e.g. in a bottom layer wire loop. The sleeve roll may be used e.g. for joining layers of a multi-ply fiber web in a sleeve roll nip between the sleeve roll and the opposite wire of a twin-wire forming part.

In this application, the terms "belt" and "sleeve roll belt" refer to a belt suitable for a sleeve roll unless otherwise stated. The belt 10 can be suitable for a sleeve roll of a paper, board, pulp, or tissue machine. The sleeve roll belt 10 can be arranged on a sleeve roll 100 which can be located e.g. at a wire section of a paper, board, pulp, or tissue machine. The sleeve roll belt 10 is typically shaped like an endless loop. The sleeve roll belt can be used to improve water removal from very wet fiber web in the wire section.

Figure 1B:
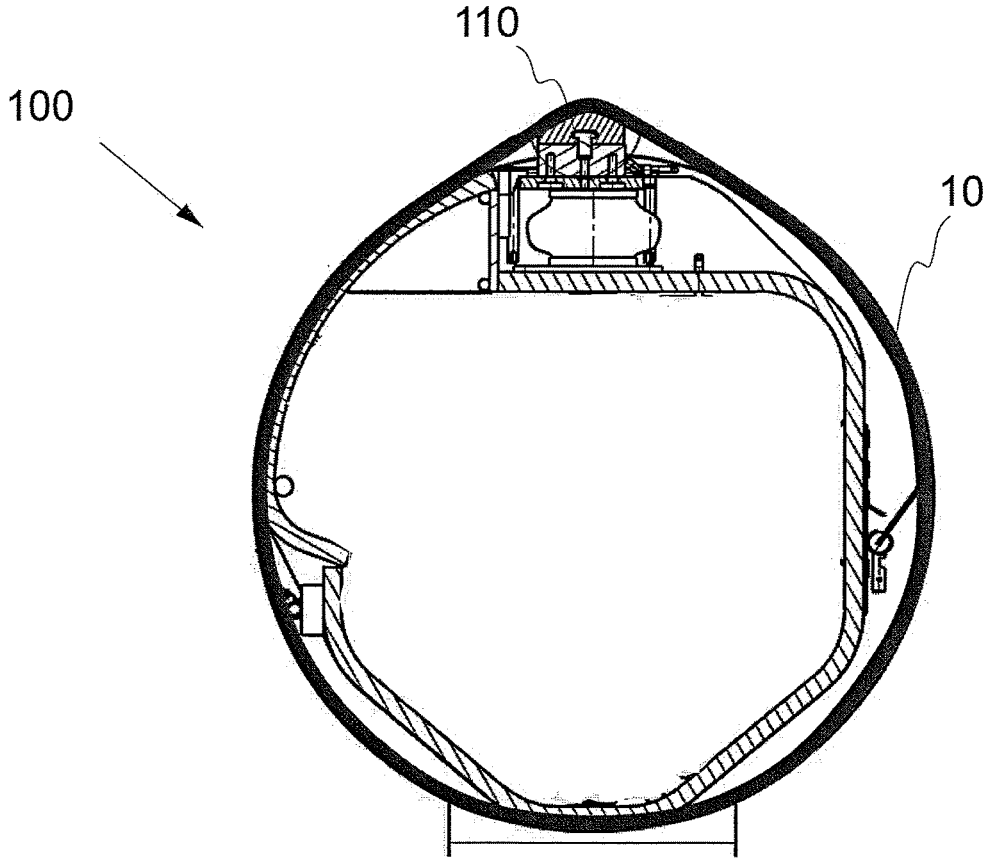

Examples of a sleeve roll 100 is illustrated in FIGS. 1*a* and 1*b*. The sleeve roll 100 can comprise a support shaft 102. The sleeve roll further comprises the sleeve roll belt 10 located around an outer surface the sleeve roll 100. The sleeve roll belt 10 can be led to circle around the support shaft 102.

Still further, the sleeve roll 100 can comprise support elements located at a distance from each other on the support shaft 102. The sleeve roll belt 10, which can circle around the outer surface of the sleeve roll, can be supported by the support elements.

The sleeve roll 100 can further comprise a curve element 110. In operation, the sleeve roll belt typically runs through the dewatering zone on the curve element. The curve element 110 can cause increased forces which stretch the sleeve roll belt on the curve element 110. The curve element 110 can be movable, i.e., a radius of curvature of the sleeve roll belt on the on the surface of the curve element 110 can be controlled by moving the curve element 110 towards the center of the sleeve roll or outward from the outer surface of the sleeve roll. Thus, stretching of the sleeve roll belt 10 may vary from a normal rate to a very high rate.

The sleeve roll belt 10 is or can be arranged in connection with the sleeve roll 100 in such a way that its outer surface 12 faces the fiber web and its inner surface 11 faces the sleeve roll. Thus, the sleeve roll 100 can be encircled by the sleeve roll belt 10 having the shape of a loop.

A circumference of the sleeve roll belt may be increased and decreased during operating hours of the belt due to the movable curve element 110. Therefore, the sleeve roll belt may have high elasticity in order to be able to handle the stretching caused by the curve element 110 of the sleeve roll. Further, the sleeve roll belt may have good strength properties so that it does not break easily.

FIG. 1*a* illustrates an example of a sleeve roll 100, which comprises a stationary support shaft 102 and the sleeve roll belt 10. The sleeve roll belt 10 is led to circle around the stationary support shaft 102. Further, wire(s) can be led via the curvilinear dewatering zone C1, C2, which dewatering zone can be supported by the sleeve roll belt 10.

The sleeve roll 100 can comprise at least one curvilinear dewatering zone C1, C2 comprising typically at least two partial curves C1, C2 such that the radius of curvature of a first partial curve C1 may be greater than the radius of curvature of a second partial curve C2 following the first partial curve in the travel direction MD of the sleeve roll belt. This can improve the water removal from the fiber web.

The curvilinear dewatering zone C1, C2 may be formed by the curve element 110 of the sleeve roll 100. The degree of curvature of the curve element 110 can increase in the travel direction of the belt 10 such that increasing dewatering pressure is applied to the fiber web travelling between the wires on said at least one curvilinear dewatering zone C1, C2 on the curve element 110. The curvilinear dewatering zone C1, C2 on the curve element 110 may contain several curves such that the radius of curvatures preferably decreases in the running direction of the wires. This can improve the water removal from the fiber web.

The sleeve roll 100 can comprise lubricant between the inner surface 11 of the sleeve roll belt 10 and the outer surface of the sleeve roll 100. Thus, the sleeve roll can comprise e.g. a lubricating pump(s), which can be used to pump lubricant into a gap between said belt 10 and the outer surface of the sleeve roll.

The curve element 110 may be moved between two or more than two positions. Therefore, the curve element 110 may be used for controlling the radius of curvature of the belt 10 on the curve element 110.

The first position of the curve element 110 can form a first surface 10*a* on the curve element, which first surface 10*a* can have substantially same radius of curvature on the sleeve roll as the surface near the curve element.

In the second position of the curve element 110, an outer surface of the curve element can be moved outward. Thus, the second position of the curve element 110 can form a second surface 10*b* on the curve element, which second surface 10*b* can have, at least partially, decreased radius of curvature. In the second position of the curve element 110, the sleeve roll belt 10 may need to stretch due to the curve element 110. Further, if the curve element 110 is movable, the sleeve roll belt 10 may need to return to its original shape when the curve element is moved back to the first position. Thus, the sleeve roll belt 10 may need to have good elasticity as well as suitable strength properties.

As discussed above, the sleeve roll belt 10 can be arranged to run around the sleeve roll 100. The inner surface 11 of the sleeve roll belt 10 can slide against the outer surface of the sleeve roll 100. A fiber web to be treated can be led to the sleeve roll belt 10, typically supported by one or more than one fabric, such as a wire.

The sleeve roll belt 10 has a cross directional length, a circumference, and a thickness. The thickness is the smallest dimension. The circumference and the length can be selected for adapting the belt to a sleeve roll 100. The circumference of the sleeve roll belt 10 is determined to be such that the inner diameter of the sleeve roll belt 10, when in operation, will be suitable for the use.

The circumference of the sleeve roll belt 10, that is, the length of one rotation, may be equal to or more than 2.2 m, for example equal to or more than 3.0 m, or equal to or more than 3.4 m. Furthermore, the circumference of the sleeve roll belt is preferably not greater than 6.3 m, for example equal to or less than 6.0 m, or equal to or less than 5.8 m. The length of the sleeve roll belt in the cross direction is determined according to the machine width and may be, for example, in a range between 1.5 m and 12.6 m.

The thickness of the sleeve roll belt can be at least 1.5 mm, more preferably at least 2.0 mm, and most preferably at least 2.5 mm. Thus, the first yarns may be easily arranged into the belt. Further, the belt may have good strength. Furthermore, the thickness of the sleeve roll belt can be equal or less than 7 mm, more preferably equal or less than 5 mm, and most preferably equal or less than 4 mm, for example in a range of 2.5 mm-5 mm. This thickness can be particularly suitable for sleeve rolls. Further, said thickness together with materials and a structure of the belt can provide good strength properties for the sleeve roll belt.

Figure 2A:
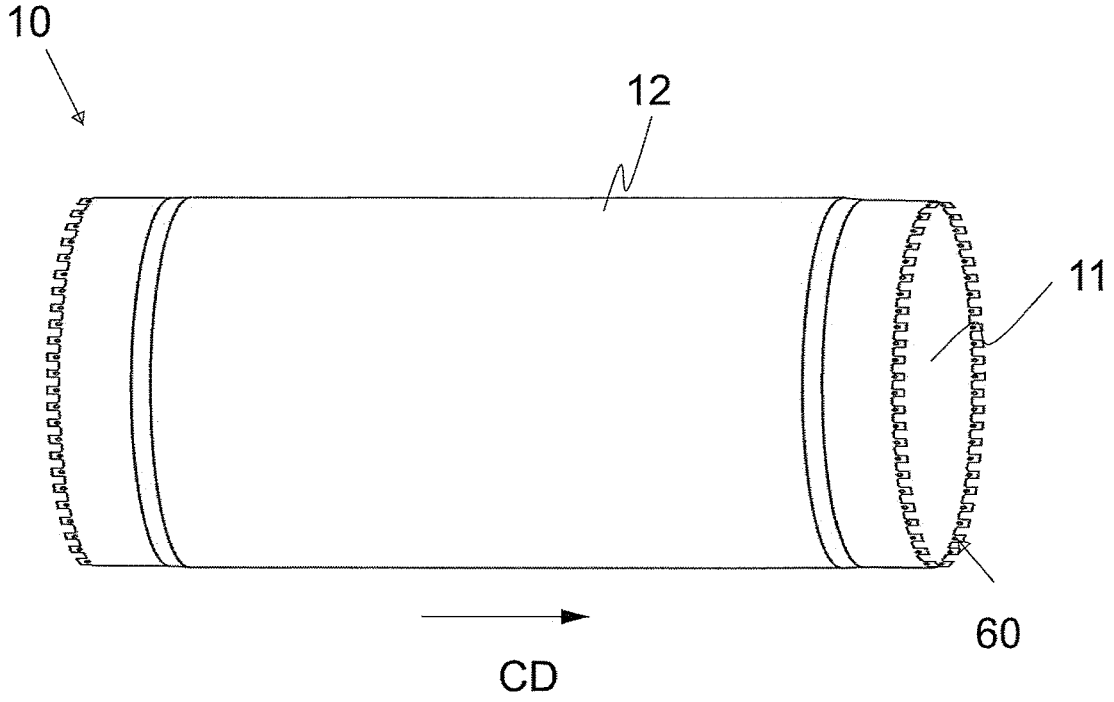
FIG. 2*a* shows an example of a belt of the invention.
Figure 2B:
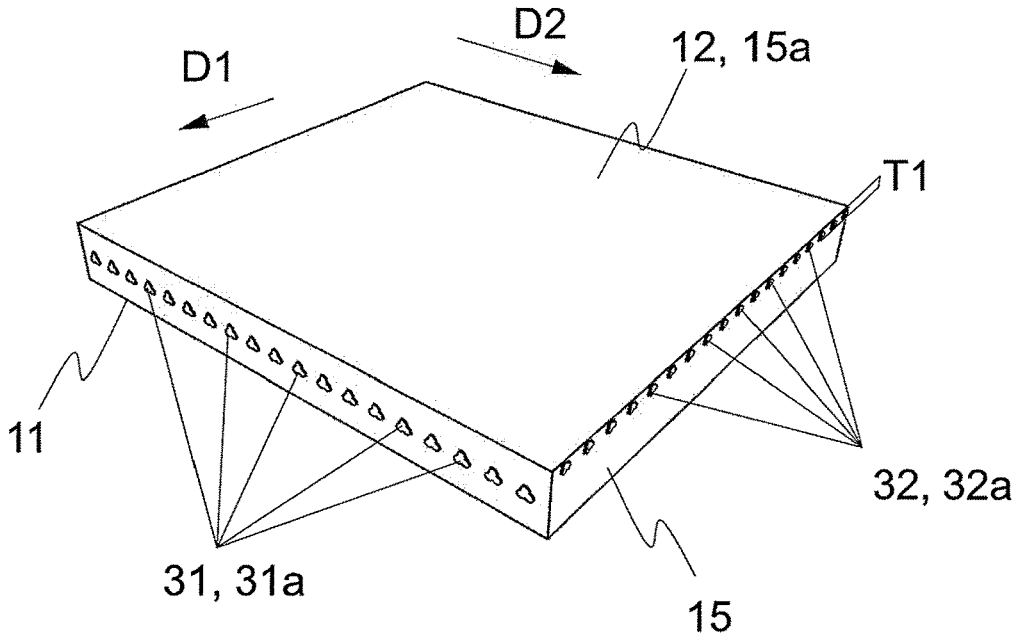
Figure 3A:
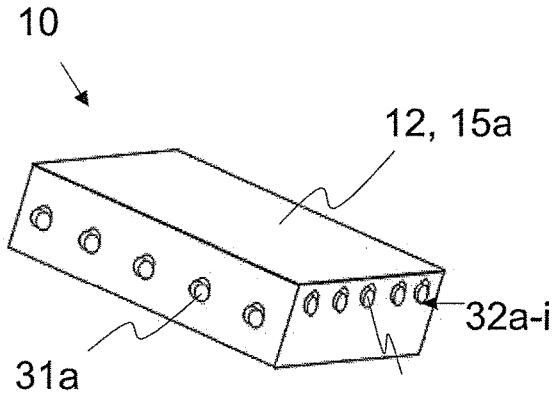
Figure 3B:
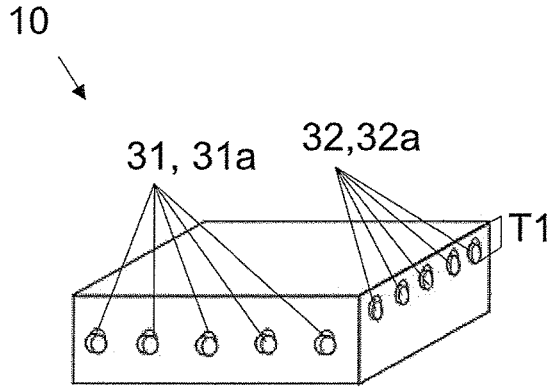
Figure 3C:
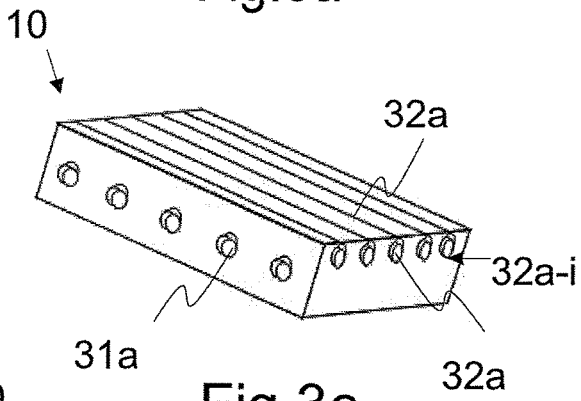
Figure 3D:
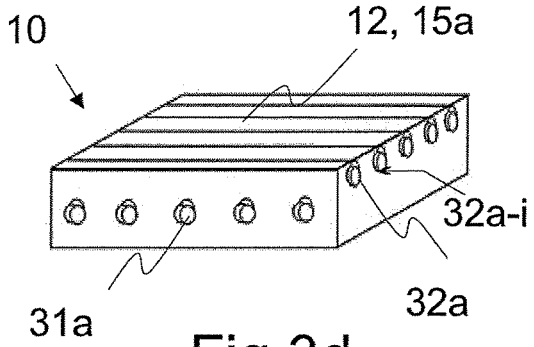
Figure 3E:
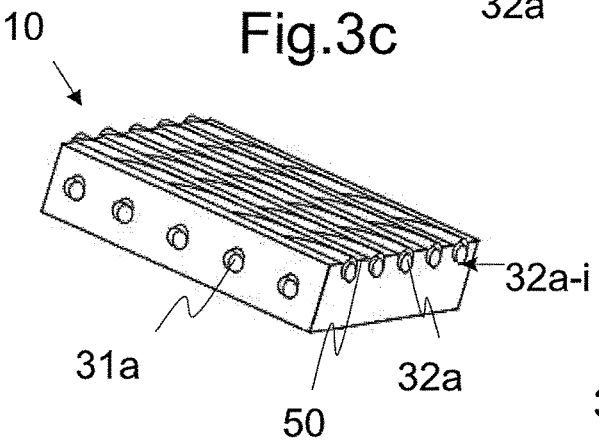
Figure 3F:
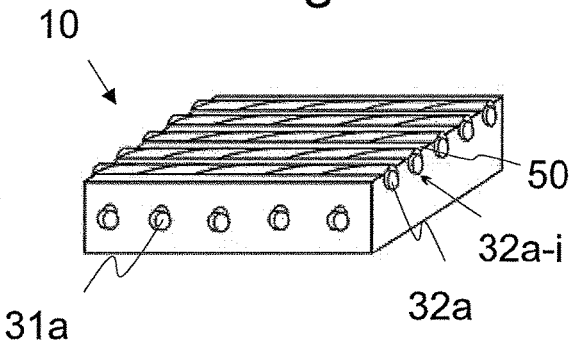

The outer surface 12 of the sleeve roll belt can be smooth or substantially smooth as shown e.g. in FIGS. 2*b*, 3*a* and 3*b*, i.e., the elastic body may not have e.g. grooves on its outer surface. Advantageously, if an outer surface 15*a* of the elastic body 15 has grooves 50 (excluding grooves formed by yarns), the depth of said grooves is less than 0.4 mm and most preferably less than 0.3 mm. However, the outer surface 15*a* of the elastic body may not have grooves at all.

Thus, the second yarns 32*a* can be arranged near the outer surface 12 and/or on the outer surface 12 of the belt. Therefore, properties of the sleeve roll belt may be improved so that the surfaces of the belt and a wire therein may wear less. The outer surface 12 of the belt can be arranged to perform properly with the second yarns 32*a* so that the second yarns 32*a* are not harmed e.g. due to said grooves.

Figure 4A:
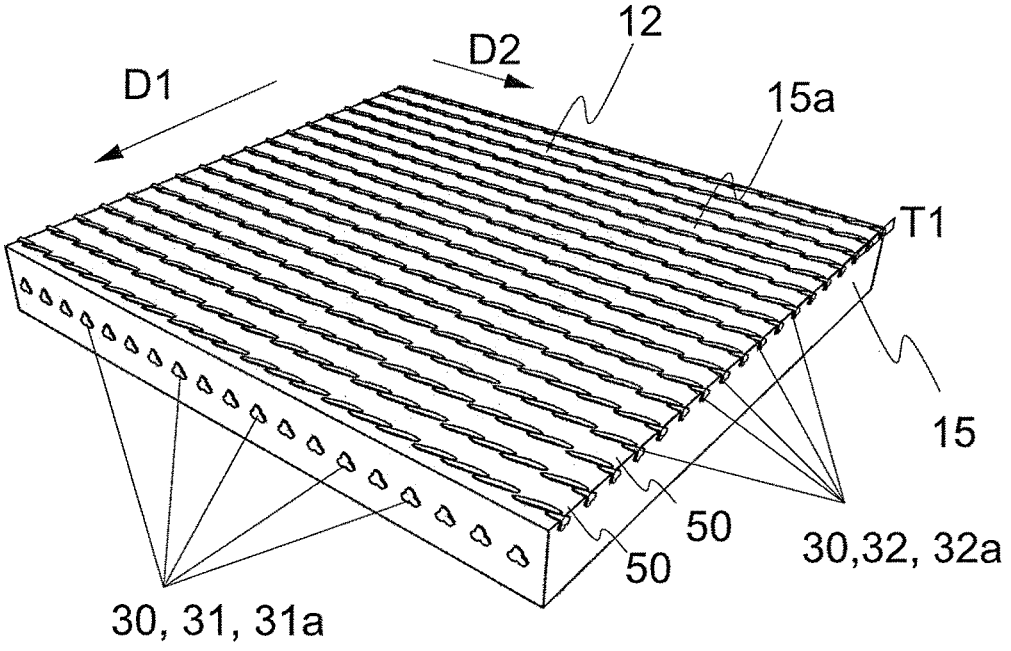
Figure 4B:
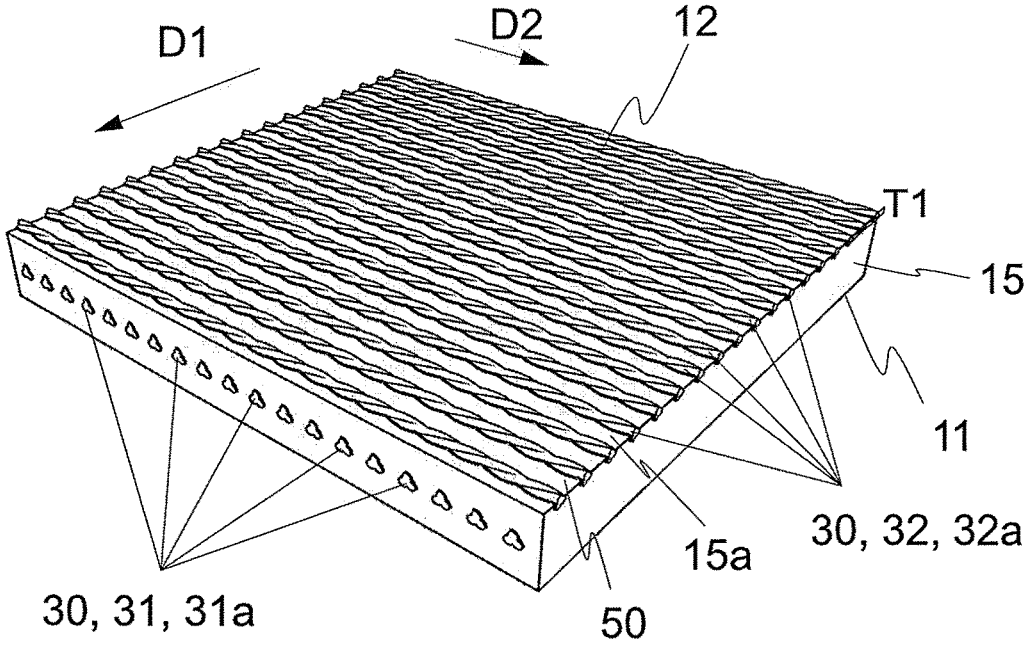

The outer surface 12 of the sleeve roll belt can comprise several parallel grooves 50. Each groove 50 can be formed between two adjacent second yarns 32*a* in order to improve dewatering properties of the sleeve roll belt. The grooves 50 formed between the second yarns 32*a* are illustrated e.g. in FIG. 4*b*. Thus, the second yarns 32*a* can be arranged (at least partially) on the surface of the elastic body so that the grooves are formed between said adjacent yarns. Thus, the grooves 50 can be separated by the second yarns 32*a*.

In use, the sleeve roll belt 10 may be fitted or intended to be fitted in a target in such a way that said dewatering grooves 50 will, when facing the fiber web, extend in the running direction of the fiber web, i.e. in the travel direction of the belt, or at least substantially in said travel direction of the belt. The function of the dewatering grooves 50 formed between the second yarns 32*a* can be to enhance the removal of water from the fiber web to be dewatered by means of the sleeve roll belt 10 and thereby to increase the dry content of said fiber web. When the fiber web runs on the curve element 110 and the sleeve roll belt therein, at least some water may run through the wire into the grooves 50.

The outer surface of the sleeve roll may have grooves formed between the second yarns 32*a*, the grooves covering an area from 0% up to 99%, determined from the total area of the outer surface of the belt. Thus, in an embodiment, the outer surface of the sleeve roll comprises more than 50% grooves, such as in a range between 55% and 85%, determined from the total area of the outer surface of the belt. In this case, the depth of the grooves is preferably equal to or less than a diameter of said yarns forming the grooves.

The depth of the groove 50 formed between the adjacent second yarns 32*a* is preferably from 0.1 mm up to a diameter of the second yarns forming the groove. The depth of the groove formed between two adjacent second yarns 32*a* can be e.g. at least 0.4 mm and not greater than 2.0 mm, measured from the deepest point of the dewatering groove to an outer surface of the second yarn 32*a*. The depth of the groove 50 formed between two adjacent second yarns 32*a* is preferably equal to or more than 0.1 mm, more preferably equal to or more than 0.2 mm and most preferably equal to or more than 0.3 mm, measured from the deepest point of the dewatering groove to an outer surface (i.e. top surface) of the second yarn 32*a*. Thus, it is possible to improve water removal rate of the belt. Further, by arranging the second yarns 32*a* near the surface of the belt, it is possible to decrease wear of the belt. Further, the depth of the groove formed between two adjacent second yarns 32*a* is preferably less than 1.5 mm, such as equal to or less than 1.0 mm, more preferably equal to or less than 0.7 mm, and most preferably equal to or less than 0.5 mm, measured from the deepest point of the dewatering groove to an outer surface (i.e., top surface) of the second yarn 32*a*. Thus, the smoothness of the outer surface may be improved. Further, it is possible to use yarns which have a quite small diameter.

The width of the dewatering groove 50 formed between the second yarns 32*a* can be e.g. equal to or more than 0.5 mm and not greater than 2.0 trim. The distance between the central lines of two parallel adjacent dewatering grooves 50 can be e.g. at least 1.0 mm and not greater than 5.0 mm. The width of the second yarn 32*a* (i.e., typically a diameter of said yarn) forming a land between two dewatering grooves 50 may be equal to or more than 1.0 mm and not greater than 5.0 mm. Factors effective on the water volume of the outer surface of the sleeve roll belt include the cross-sectional area of the dewatering grooves as well as the density of the dewatering grooves (number/m in the cross direction). The number of dewatering grooves 50 may be at least 140/m, advantageously at least 200/m, and advantageously not greater than 670/m. With the above-mentioned features of the dewatering groove 50 (width of the groove, depth, distance between central lines, number of dewatering grooves), water can be removed from the web more efficiently via said dewatering groove 50. These benefits are typically realized the better, the more of above-mentioned features are implemented in the sleeve roll belt 10.

The depth of the groove formed between two adjacent second yarns 32*a* can be e.g. in a range between 10% and 100%, more preferably equal to or more than 20% such as between 20% and 80%, and most preferably equal to or more than 30%, such as between 30% and 60% calculated from a diameter of the yarns forming the groove. Further, the depth of the groove is preferably equal to or less than 90%, more preferably equal to or less than 70%, and most preferably equal to or less than 50%, calculated from the diameter of the yarns 32*a* forming said groove.

The sleeve roll belt can be bendable, i.e., the belt can be capable of being bent at least to a predetermined radius of curvature without breaking. The predetermined radius of curvature can be smaller than radius of curvature of the surface of the curve element 110, in any position of the curve element 110, hence, the belt may not be easily damaged.

The sleeve roll belt 10 can comprise an elastic body 15 in order to have a good elasticity. In this application, the term "elasticity" refers to an ability of the belt to return to its original shape after stretching or pressing. The sleeve roll belt 10 can further comprise a reinforcing structure 30 in order to obtain good strength properties. However, the elasticity of the sleeve roll belt may need to be substantially high, hence, the reinforcing structure should not decrease the elasticity of the sleeve roll belt too much.

The inner surface of the sleeve roll belt can be substantially smooth. The sleeve roll belt 10 may or may not comprise a pattern on the inner surface 11 of the belt 10. The inner surface 11 may comprise a slight patterning, i.e. so-called buffing. The depth of the buffing may be, for example, 0 to 15 μm, preferably from 0.01 μm to 4.00 μm. Furthermore, the depth of the buffing may be at least 0.05 μm. Said roughness of the inner surface of the belt may have a substantial effect on the durability of the sleeve roll belt. For example, if the uniformity of the lubricating oil film were broken, the combination of the surface of the sleeve roll and the rough inner surface of the sleeve roll belt would not be as sensitive to decelerate as the combination of the smooth metal surface of the sleeve roll and the smooth inner surface of the sleeve roll belt. In such a situation, the sleeve roll belt having an inner surface 11 with a buffing may not be as easily damaged as a belt having smoother inner surface.

The outer surface 12 of the belt 10 is preferably designed such that it will not cause marking in the fibrous web. Further, the outer surface 15*a* of the elastic body 15 may be substantially smooth to provide an even surface for the second yarns 32*a*. However, the outer surface 12 of the sleeve roll belt may comprise a slight patterning, i.e. so-called buffing. The depth of the buffing on the outer surface 15*a* of the elastic body 15 may be, for example, 0 to 50 μm. In an embodiment, the depth of the buffing on the outer surface 15*a* of the elastic body may not be greater than 20 μm. Furthermore, the depth of the buffing on the outer surface 15*a* of the elastic body may be at least 0.01 μm. Said roughness of the outer surface 15*a* of the elastic body may, in some cases, have advantageous effects on its action together with the paper machine fabric.

The sleeve roll belt 10 can be made of materials, which are suitable for paper, board, pulp, and tissue machines, which do not harm the wire or the fiber web, and which have suitable stretching and strength properties.

The sleeve roll belt can comprise polymer(s). The elastic body 15 may comprise or consist of elastomer material. The elastomer material is preferably the main raw material of the sleeve roll belt.

The sleeve roll belt may comprise or consist of polyurethane, and/or natural rubber (NR), and/or synthetic rubber (SR), the amount of said materials being preferably at least 50 wt. %, more preferably at least 70 wt. %, and most preferably equal to or more than 80 wt. %, calculated from the total weight of the belt. Thus, the elasticity, and bendability of the belt may be improved. These materials can be used to obtain good strength and elasticity properties; hence, the belt may be able to stretch and bend during operating hours without breaking. Furthermore, the sleeve roll belt may comprise not more than 99.8 wt.-%, more advantageously not more than 97 wt.-% and preferably not more than 95 wt.-% said materials, calculated from the total weight of the sleeve roll belt. For example, the reinforcing structure typically comprises other material(s).

The sleeve roll belt may comprise polyurethane. Preferably, the elastic body consists of polyurethane or contains primarily polyurethane. Advantageously, the sleeve roll belt comprises at least 50 wt.-%, more advantageously at least 70 wt.-%, and preferably at least 80 wt.-% polyurethane, calculated from the total weight of the sleeve roll belt. Furthermore, the sleeve roll belt may comprise not more than 99.9 wt.-%, more advantageously not more than 97 wt.-% and preferably not more than 95 wt.-% polyurethane, calculated from the total weight of the sleeve roll belt. Polyurethane may improve the properties of the sleeve roll belt, such as elasticity and bendability, and be particularly suitable for use in combination with the curve element of the sleeve roll.

The curve element 110 of the sleeve roll may cause high stress to the sleeve roll belt. Thus, the sleeve roll belt 10 may need to have suitable reinforcing structure. However, due to the curve element which typically forces the sleeve roll belt to stretch and/or compress, the sleeve roll belt might need to have both; good strength as well as good elasticity. Conventionally, it has been challenging to obtain a belt suitable for sleeve rolls. Typically, the reinforcing structure should not prevent e.g. a stretching of the belt on the curve element 110.

The reinforcing structure 30 of the sleeve roll belt may comprise:

yarns which are arranged into the belt so that the material of the elastic body surrounds the yards, and/or yarns which are arranged at least partially on the elastic body so that said yarns are at least partially visible to a human eye.

The reinforcing structure 30 of the sleeve roll belt can comprise second yarns 32*a* which are arranged:

at least partially into the belt 10 so that the material of the elastic body surrounds the yarns at least partially and/or at least partially on to the outer surface 15*a* of the elastic body 15 so that said second yarns 32*a* are at least partially visible to a human eye.

Thus, the belt may comprise second yarns 32*a* which are arranged to the outer surface of the belt and/or near the outer surface of the belt. Thus, the novel sleeve roll belt may have an improved reinforcing structure 30, which may have good strength properties as well as good elasticity and ability to stretch. Further, thanks to said novel reinforcing structure, wear of the belt may be reduced.

FIGS. 2*b*, 3*a-f* and 4*a-b* illustrate example structures of the belt 10 comprising an elastic body 15 and yarns 32*a*, 31*a*. The elastic body 15 may have an ability to return to its original shape after pressing and stretching. Thus, the elastic body 15 can have a capacity to reassume its initial shape after being compressed. Said Figures illustrate the first yarns 31*a* and the second yarns 32*a*. The belt may comprise the material of the elastic body 15 between the adjacent first yarns 31*a*.

As discussed above, the sleeve roll belt 10 can comprise a reinforcing structure 30, which may be a support structure formed by yarns 31*a*, 32*a*. The yarns 31*a*, 32*a* are preferably arranged in layers within the elastic body 15. The reinforcing structure 30 may provide suitable strength properties for the sleeve roll belt as well as an ability to return its original shape after the stretching caused e.g. by the curve element 110.

The reinforcing structure 30 can comprise a first yarn layer 31 and a second yarn layer 32. The first yarn layer 31 comprises first yarns 31*a* which are arranged in the first direction D1, preferably within the elastic body 15. The second yarn layer 32 comprises second yarns 32*a* which are arranged in the second direction D2.

The first yarns 31 can be arranged perpendicular or substantially perpendicular to the second yarns 32. The technical effect is to provide good strength properties to the travel and cross directions of the sleeve roll belt. Preferably, a total of two reinforcing yarn layers 31, 32 are provided.

As discussed, the reinforcing structure 30 of the sleeve roll belt 10 can comprise the first yarns 31*a* formed parallel to the first direction D1. The first direction can be parallel or substantially parallel to the cross-direction CD of the sleeve roll belt. An angle between the first yarns 31*a* and the cross-direction CD is preferably less than 15°, more preferably less than 10°, and most preferably less than 5°. The first yarns 31*a* may not need to have high stretchability because the belt does not substantially stretch to the cross direction. However, the first yarns 31*a* may need to have good strength. The technical effect of the first yarns 31*a* is to improve the dimensional stability of the sleeve roll belt in the cross direction.

In an embodiment, elasticity of the first yarns is smaller than elasticity of the second yarns. In another embodiment, elasticity of the first yarns is not smaller than elasticity of the second yarns.

The reinforcing structure 30 can comprise the second yarns 32*a*. The second yarns 32*a* are formed parallel to the second direction D2. The second yarns may be formed substantially perpendicular to the first direction D1. The second direction can be parallel or substantially parallel to the travel direction MD of the sleeve roll belt. An angle between the second yarns 32*a* and the travel direction MD of the belt is preferably less than 15°, more preferably less than 10°, and most preferably less than 5°. Thus, it can be possible to form good reinforcing structure for the travel direction of the sleeve roll belt 10. The yarns 32 of the second yarn layer 32 may have high stretchability due to the curve element 110 of the sleeve roll. Further, the second yarns may have good strength properties.

The technical effect of the second yarns 32*a* is to improve the stretchability and/or the elasticity of the sleeve roll belt while providing sufficient dimensional stability and strength.

The neutral axis of the belt is preferably located near the outer surface of the sleeve roll belt in order to prevent the belt to wear too quickly. Thus, the second yarns are preferably arranged near the outer surface 12 of the belt. Thus, the second yarns 32*a* can be arranged on the outer surface 12 of the elastic body and/or near the outer surface of the sleeve roll belt. Thus, the belt may not wear so easily as conventionally. Thus, the cost efficiency of the belt may be improved.

The second yarns 32 can be visible to a human eye as shown in FIGS. 3*c-f* and 4*a-b*. Preferably, the second yarns 32*a* are at least partially embedded in the elastic body as illustrated in FIGS. 2*b*, 3*a-f*, and 4*a-b*.

The second yarns 32*a* can be arranged at least partially into the elastic body 15 of the belt 10. The second yarns 32*a* can be arranged to a depth T1, which depth T1 is in a range between 0 mm and 2.0 mm measured from an outer surface 15*a* of the elastic body 15 to a bottom 32*a-i* of the second yarn 32*a* in the depth direction of the belt. Preferably, the second yarns 32*a* are arranged to a depth T1 of equal to or more than 0.1 mm, more preferably to a depth T1 of equal to or more than 0.3 mm, and most preferably to a depth of equal to or more than 0.5 mm, measured from the outer surface 15*a* of the elastic body 15 to the bottom 32*a-i* of the second yarn 32*a* in the depth direction of the belt. Further, the second yarns 32*a* are preferably arranged to a depth T1 of equal to or less than 2.0 mm, more preferably to a depth T1 of equal to or less than 1.5 mm, and most preferably to a depth T1 of equal to or less than 1.0 mm, such as to a depth T1 in a range between 0.2 mm and 1 mm, measured from the outer surface 15*a* of the elastic body 15 to the bottom 32*a-i* of the second yarn 32*a* in the depth direction of the belt. The technical effect is that the neutral axis of the belt can be near the outer surface of the sleeve roll belt. Thus, in use, a speed difference between:

the outer surface of the belt, and a surface of a wire which is in contact with the belt may be reduced. Further, thanks to the novel solution, a friction between the belt and the wire may be reduced. Thus, the surface wear of the belt as well as the surface wear of the wire may be reduced. Furthermore, the yarns may form grooves on the surface of the belt. Thus, water removal efficiency of the belt may be improved.

Thus, the second yarns 32*a* are preferably arranged on the outer surface of the belt, and/or near the outer surface of the belt. If the second yarns 32*a* of the second yarn layer 32 are aligned (at least substantially) in the travel direction of the belt and arranged near the outer surface of the belt, it is possible to significantly decrease wearing of the belt as well as wearing of the wire. Thus, the costs caused by the belt may be decreased.

Thanks to the novel solution, a radius of curvature on the curve element 110 can be smaller than conventionally. Hence, it may be possible to use such curve elements which can cause a very small radius of curvature to the belt. This may improve the effectiveness of the sleeve roll 100.

As discussed above, the second yarns 32*a* can be visible to a human eye, i.e. at least some surfaces of said yarns can be seen. If the second yarns 32*a* are visible to a human eye, the neutral axis of the belt is typically very close to the outer surface of the sleeve roll belt. Thus, in use, the speed level of the belt may be easier to control and, hence, a speed difference between the belt and a wire may be very small. Thus, wear of the belt and the wire may be reduced.

By arranging the neutral axis of the belt near the outer surface of the belt, the outer surface of the belt can wear less, and the inner surface of the belt may wear more. However, this may not cause problems to the belt, because there is typically a lubricant layer, such as an oil layer, between the sleeve roll and the inner surface of the belt. Thus, the friction between the belt and the sleeve roll is typically very low. Therefore, the inner surface of the belt may not wear much even if the neutral axis of the belt is near the outer surface of the belt.

As discussed above, the sleeve roll belt 10 may comprise or consist of two layers 31, 32 of reinforcement yarns 31*a*, 32*a* which are preferably arranged perpendicular or substantially perpendicular to each other. The yarns 31*a*, 32*a*, are preferably multifilament yarns with twist. Advantageously, the yarn layers 31, 32 are arranged substantially perpendicular to each other. An angle between the first yarns 31*a* of the first yarn layer and the second yarns 32*a* of the second yarn layer is preferably around 90° such as between 80° and 100°.

The first yarns 31*a* can be arranged adjacent to each other at a distance from each other in such a manner that the elastic body material is settled around the yarns 31*a*.

The second yarns 32*a* can be arranged adjacent to each other at a distance from each other in such a manner that the elastic body material may be settled on some surfaces of the second yarns 32*a* (shown in FIGS. 3*c-f* and 4*a-b*), or around the yarns (shown in FIGS. 2*b* and 3*a-b*).

Preferably, the first yarns 31*a* are arranged into the elastic body, while the second yarns 32*a* can be arranged to the outer surface 15*a* of the elastic body 15. A diameter of the yarns as well as the number of yarns in the first and second directions of the sleeve roll belt can have effects on the properties of the sleeve roll belt.

The belt may comprise from 100 to 650 first yarns 31*a/m* arranged in the first direction, which first direction is preferably parallel or substantially parallel to the cross direction of the belt. The number of the first yarns 31*a/m* is preferably equal to or more than 140 first yarns per meter, more preferably at least 170 first yarns per meter, and most preferably equal to or more than 200 first yarns 31*a* per meter. Further, the number of the first yarns is preferably equal to or less than 620 first yarns per meter, more preferably less than 600 first yarns per meter, and most preferably equal to or less than 580 first yarns 31*a* per meter. Thus, it is possible to obtain sleeve roll belt having good strength and dimensional stability in the cross direction of the belt.

The belt may comprise from 100 to 650 second yarns 32*a* per meter arranged in the second direction, which second direction is preferably parallel or substantially parallel to the travel direction MD of the belt. The number of the second yarns 32*a* is preferably equal to or more than 140 second yarns 32*a* per meter, more preferably at least 180 second yarns per meter, and most preferably equal to or more than 200 second yarns 32*a* per meter. Further, the number of the second yarns 32*a* is preferably equal to or less than 620 second yarns per meter, more preferably less than 600 second yarns per meter, and most preferably equal to or less than 580 second yarns 32*a* per meter. Thus, it is possible to obtain good elasticity as well as good dimensional stability in the travel direction of the belt.

In an embodiment, a relative number of yarns (RNY) in the belt, i.e., number of yarns arranged in the second direction per number of yarns arranged in the first direction (RNY=D2/D1) is equal to or more than 0.5, such as between 1.1 and 3.0.

The reinforcing yarn layers 31, 32 may be on top of each other and they may be separated from each other. Thus, the yarn layers do not have to be fastened to each other or bound to each other in any way.

Thus, the yarns 31*a*, 32*a* in different layers 31, 32 may be either in contact with or bonded to the yarns of the next layer, or they may be spaced from each other.

The first yarns 31*a* can be bonded to the second yarns 32*a*. The technical effect is that the first yarns bonded to the second yarns can improve strength of the second yarn layer. This may be particularly advantageous solution if the second yarns are arranged (at least partially) on the surface of the belt.

The second yarn layer 32 can be arranged above the first yarn layer 31 e.g. at a small distance from the first yarn layer. The second yarns can be arranged e.g. from 0 mm to 1.5 mm, preferably from 0.2 mm to 1.0 mm above the first yarns.

The first yarn layer 31 can be the innermost yarn layer closest to the inner surface 11 of the sleeve roll belt 10. The first yarn layer 31 can consist of separate yarns. Thus, the adjacent yarns can be spaced from each other. Preferably, the first yarns of the first layer are spaced evenly or substantially evenly.

Each yarn of the first yarn layer can be arranged to be spaced apart by equal distances from adjacent yarns. The adjacent yarns of the first yarn layer may be spaced apart by 0.5 mm to 10 mm. Advantageously, the adjacent yarns of the first yarn layer are spaced apart by equal to or more than 0.5 mm and equal to or less than 10 mm. The area between the adjacent first yarns preferably consists of the elastic body material.

The second yarn layer 32 can be the outermost yarn layer closest to the outer surface 12 of the sleeve roll belt. The second yarn layer can consist of separate yarns, wherein adjacent yarns are spaced from each other. Preferably, the yarns of the second layer are spaced evenly or substantially evenly.

Each yarn of the second yarn layer 32 can be arranged to be spaced apart by equal distances from adjacent yarns. The adjacent reinforcing yarns of the second reinforcing yarn layer may be spaced apart by e.g. from 0.5 mm to 10 mm. Advantageously, the adjacent yarns of the second yarn layer are spaced apart by equal to or more than 0.5 mm and equal to or less than 3 mm.

The area between the adjacent second yarns may consist of the elastic body material, if it is not forming a groove.

The yarns of each yarn layer may be e.g. separate yarns adjacent to each other, or they can be formed of one or more yarns placed spirally in parallel. In an embodiment, the belt comprises a fabric layer on the surface of the elastic body 15, the fabric layer comprising first yarns 31*a* and second yarns 32*a*. It is possible to attach the fabric layer to said surface of the elastic body e.g. mechanically and/or by using a high temperature level. The fabric layer may form a closed loop on the surface of the elastic body.

The reinforcing yarns may be equal or different in thickness. Preferably, the first yarns are substantially equal in thickness with each other. Further, the second yarns are preferably substantially equal in thickness with each other.

The second yarns 32*a* may be of the same thickness as the first yarns 31*a*. However, the second yarns 32*a* may be thinner than the first yarns 31*a*. In this way, it is possible to obtain good strength properties with improved elasticity on the travel direction of the sleeve roll belt as well as good dimensional stability on the cross direction of the sleeve roll belt.

A diameter of each first yarn 31*a* can be e.g. from 0.5 mm to 2.0 mm. The first yarns 31*a* are arranged parallel to the first direction D1. The technical effect is to obtain good strength properties as well as good dimensional stability in the cross direction of the belt.

A diameter of each second yarn 32*a* can be e.g. from 0.5 mm to 2.0 mm. The second yarns 32*a* are arranged parallel to the second direction D2. The second yarns 32*a* are preferably arranged to the outer surface of the sleeve roll belt, or near the outer surface of the sleeve roll belt. The technical effect is to obtain good strength properties as well as good elasticity in the travel direction of the belt.

The reinforcing yarns 31*a*, 32*a* of the reinforcing structure 30 of the sleeve roll belt may be made of the same material or different materials. The first yarn layer 31 and the second yarn layer 32 may comprise monofilament yarns and/or multifilament yarns. Thus, each yarn can be monofilament or multifilament. Monofilament means that there is only one filament per yarn. Multifilament means that there is more than one filament per yarn. Multifilament structure can have filaments twisted together. Advantageously, the yarn layers 31, 32 comprise or consist of multifilament yarns. The number of filaments has an effect of the properties of the yarns. Preferably, the yarns are multifilament yarns having from 5 to 10 000 filaments per yarn.

The first yarns 31*a* may have equal to or more than 5 filaments per yarn, more preferably equal to or more than 200 filaments per yarn, and most preferably equal to or more than 500 filaments per yarn. Further, the first yarns may have equal to or less than 10 000 filaments per yarn, more preferably equal to or less than 4000 filaments per yarn, and most preferably equal to or less than 2000 filaments per yarn.

The second yarns 32*a* may have equal to or more than 5 filaments per yarn, more preferably equal to or more than 200 filaments per yarn, and most preferably equal to or more than 500 filaments per yarn. Further, the second yarns 32*a* can have equal to or less than 10 000 filaments per yarn, more preferably equal to or less than 4000 filaments per yarn, and most preferably equal to or less than 2000 filaments per yarn.

The sleeve roll belt 10 may be subjected to high stresses when it is stretched and/or bended on the curve element 110 of the sleeve roll. Thus, the yarns 32*a* of the second yarn layer 32 may be made from elastic material(s). The elastic material may allow the sleeve roll belt to bend at the required radius of curvature, in a manner enabling its passage on the surface 10*a*, 10*b* of the curve element.

The yarns 31*a*, 32*a* may comprise synthetic fibers having high strength, high modulus and high elastic modulus. The yarns can comprise polyamide (PA), e.g. nylon, and/or polypropylene (PP), and/or polyethylene (PE), preferably so-called high strength polyethylene, and/or rayon, and/or viscose, and/or polyester, preferably polyethylene terephthalate (PET), and/or polyvinyl alcohol (PVA, PVOH), and/or polyaramide, and/or polyphenylene sulfide (PPS), and/or liquid crystal plastic (LCP), and/or polyimide, and/or carbon fibers, and/or
carbon fiber/thermoplastic composite, and/or
polyethylene naphthalate (PEN), and/or
polyether ether ketone (PEEK).

The amount of said materials is preferably at least 60 wt. %, more preferably at least 80 wt. %, and most preferably at least 95 wt. %, calculated from the total weight of the yarns. Thus, the yarns comprising or consisting of the above-mentioned materials can stiffen the belt, but still allow the necessary level of bending and stretching of the belt.

The first yarns 31*a* preferably comprise or consist of:
polyamide (PA), and/or
polyethylene (PE), and/or
polyester, preferably polyethylene terephthalate (PET), and/or
aromatic polyamide, and/or
carbon fibers, and/or
carbon fiber/thermoplastic composite yarns.

For example, carbon fibers can be used to improve strength of the belt and to stiffen the belt. Further, carbon fibers can be used to minimize stretching of the belt in the cross direction. Polyester and polyamide may provide good support for the cross direction of the belt. The first yarns are preferably multifilament yarns, which are either stranded or twisted at a high twist level in a manner known per se.

The second yarns 32*a* preferably comprise or consist of:
polyamide (PA), and/or
polyethylene (PE), and/or
polyester, preferably polyethylene terephthalate (PET), and/or
aromatic polyamide, and/or
carbon fibers, and/or
carbon fiber/thermoplastic composite yarns.

For example, polyester may provide good support for the travel direction of the belt. If the second yarns comprise carbon fiber composites, the belt may not, in some cases, stretch as much as with some other materials. However, carbon fiber composites can improve strength of the belt. The second yarns are preferably multifilament yarns, which are either stranded or twisted at a high twist level in a manner known per se. The second yarns may have a greater stretchability than the first yarns. The second yarns may have e.g. at least 4% greater, more preferably at least 8% greater stretchability than the first yarns. In this case, the belt may stretch easily on the curve element of the sleeve roll while providing good stiffness on the cross direction of the belt.

The strength of yarns, i.e., specific stress (N/tex), of each second yarn 32*a* can be e.g. in a range between 0.4 N/tex and 3 N/tex. N/tex refers to Newton per tex. Thus, it is possible to obtain good strength properties in travel direction of the belt.

The strength of yarns, i.e., specific stress (N/tex), of each first yarn 31*a* can be e.g. in a range between 0.4 N/tex and 3 N/tex. Thus, it is possible to obtain good cross directional strength properties for the belt.

A breaking strength of the sleeve roll belt can be e.g. equal to or more than 100 kN/m, such as from 170 kN/m to 230 kN/m, measured in the travel direction of the sleeve roll belt. Thus, the belt may not be easily damaged even in special cases e.g. due to an emergency stop of a machine, or if there is not much oil between the outer surface of the sleeve roll and the inner surface of the sleeve roll belt e.g. due to starting of the sleeve roll after a machine downtime. Further, the breaking strength of the belt is preferably smaller than a breaking strength of the sleeve roll in order to protect the sleeve roll. Still further, said breaking strength may also provide good elasticity for the sleeve roll belt.

Elasticity of the belt is the ability of the belt to return to its original shape when a force is removed. The sleeve roll belt can be elastic so that it will return to its initial shape and length when the forces caused by a curve element are removed. The stretching of the belt can be controlled by the reinforcing structure 30 of the sleeve roll belt.

The novel sleeve roll belt may have a lighter reinforcing structure in the second direction D2 than in the first direction D1 of the belt. The technical effect is to have good stretchability in the second direction. Therefore, the second yarns 32*a* can yield and thus stretch in their longitudinal direction when the sleeve roll belt is bent due to the curve element 110 such that it may need to stretch. However, the reinforcing structure may be able to control the stretching level of the belt. Thus, the novel sleeve roll belt may not be as easily damaged as a belt without said reinforcing structure. Alternatively, the novel sleeve roll belt may have the same or a lighter reinforcing structure in the first direction than in the second direction.

A load at specific elongation as well as breaking strength are determined based on the standard SFS 2983. The values can be determined by using Alwetron TCT 20 device from Lorentzen & Wettre AB (Lorentzen & Wettre, Sweden). A constant rate of elongation (CRE) is used while determining test values. The application of load is made in such a way that the rate of elongation of the sample is kept constant. A computerized control system can be used to maintain constant force. The elongation rate applied to the samples is 10 mm/min. During the measurements, a sample between the stationary and the moving clamp is extended by a constant distance per unit of time (10 mm/min) and the force required to do so is measured. The breaking elongation is calculated from the clamp displacement.

The total size of the test sample is 240 mm×30-40 mm, wherein the length of the test sample is 240 mm and the width of the sample is 40 mm in the both ends of the sample and 30 mm in the middle of the sample. The width of the sample in contact with the clamp is 40 mm. During measurements, a load of 2 kN±0.1% is used for samples having a maximum load of less than 1.7 kN. Further, a load of 20 kN±0.1% is used for samples having a maximum load equal to or more than 1.7 kN.

The sleeve roll belt may have a load at specific elongation of 2% in a range between 28 kN/m and 50 kN/m. The load at specific elongation of 2% can be equal to or more than 28 kN/m, preferably equal to or more than 30 kN/m, such as equal to or more than 35 kN/m determined in the travel direction of the sleeve roll belt and measured according to standard SFS 2983. Further, the load range at specific elongation of 2% may be equal to or less than 50 kN/m, or equal to or less than 40 kN/m, determined in the travel direction of the sleeve roll belt and measured according to standard SFS 2983. Thus, the belt may have good stretchability as well as good dimensional stability properties. The load at specific elongation of 2% refers to a load causing said elongation.

The sleeve roll belt may have a load range at specific elongation of 4% in a range between 47 kN/m and 60 kN/m. The load at specific elongation of 4% can be equal to or more than 47 kN/m, more preferably equal to or more than 50 kN/m, and most preferably equal to or more than 52 kN/m, determined in the travel direction of the sleeve roll belt and measured according to standard SFS 2983. Further, the load range at specific elongation of 4% may be less than 60 kN/m, for example equal to or less than 58 kN/m, determined in the travel direction of the sleeve roll belt. The technical effect is that the belt may perform well with high loads and have good stretchability as well as good dimensional stability properties. Further, belts having said specific elongations (2% and 4%) may have good predictability, i.e., elongations of the belt may be predicted in different stresses.

The sleeve roll belt can be configured to stretch equal to or more than 1.5%, such as in a range between 1.5% and at least 3.0%, in the travel direction of the belt so that it will return in its original length after the force stretching the belt has been removed. Preferably, the sleeve roll belt can be configured to stretch at least 1.8%, more preferably at least 2.1% in the travel direction of the sleeve roll belt so that it will return in its original length after the force stretching the belt has been removed.

The sleeve roll belt, as well as the yarn layers therein, can be made in manners known per se. The sleeve roll belt can be manufactured, e.g., by providing several support yarns;

shaping an elastic body for a sleeve roll belt by casting at least one elastomer material against a mold surface; and curing the frame.

The sleeve roll belt is intended to be installed on the sleeve roll of a board machine, a paper machine, a pulp machine, or a tissue machine, preferably in the wire section therein. The sleeve roll belt may further comprise e.g. plurality of attaching points 60 of the belt for an installation of the belt.

The invention has been described with the aid of illustrations and examples. The invention is not limited solely to the above presented embodiments but may be modified within the scope of the appended claims.

I claim:

1. A sleeve roll belt in a forming section of a paper, board, pulp or tissue machine, the sleeve roll belt forming a closed loop and having an inner surface and an outer surface, wherein the sleeve roll belt comprises:

an elastic body having an outer surface, a neutral axis, and a reinforcing structure; wherein the reinforcing structure comprises:

first yarns arranged to a first direction within the elastic body of the sleeve roll belt, and second yarns arranged to a second direction of the sleeve roll belt;

wherein the second yarns are arranged, on the elastic body such that each second yarn is arranged at a depth away from the outer surface so no portion of the second yarns is more than 2 mm within the elastic body so the neutral axis of the sleeve roll belt is arranged near the outer surface of the elastic body of the sleeve roll belt; and wherein a number of the second yarns is from 140 yarns/m to 620 yarns/m, and/or a number of the first yarns is from 140 yarns/m to 620 yarns/m.

2. The sleeve roll belt of claim 1 wherein the second direction is substantially parallel to a travel direction of the sleeve roll belt, and the first direction is substantially parallel to an axis of rotation of the sleeve roll belt, and the second direction is substantially perpendicular to the first direction.

3. The sleeve roll belt of claim 1 wherein the second yarns form grooves between the adjacent second yarns on the outer surface of the sleeve roll belt.

4. The sleeve roll belt of claim 3 wherein the outer surface of the sleeve roll belt comprises 140 or more grooves per meter.

5. The sleeve roll belt of claim 3 wherein the grooves define a depth of the grooves wherein the depth of the grooves is between 0.3 mm and 2.0 mm.

6. The sleeve roll belt of claim 1 wherein the outer surface of the sleeve roll belt is such that deviations from the outer surface have a depth of less than 0.3 mm.

7. The sleeve roll belt of claim 1 wherein the second yarns extend to a depth of from 1 mm to less than 0.8 mm measured from the outer surface of the elastic body to the bottom of the second yarn in the depth direction of the sleeve roll belt.

8. The sleeve roll belt of claim 7 wherein the second yarns extend to a depth equal to or less than 0.5 mm measured from the outer surface of the elastic body to the bottom of the second yarn in the depth direction of the sleeve roll belt.

9. The sleeve roll belt of claim 1 wherein the second yarns are arranged so that the elastic body partially surrounds the second yarns and said second yarns are at least partially visible to a human eye.

10. The sleeve roll belt of claim 1 wherein the sleeve roll belt has a breaking strength of from 100 kN/m to 230 kN/m measured in the travel direction of the sleeve roll belt.

11. The sleeve roll belt of claim 1 wherein each second yarn has a diameter between 0.5 mm and 10 mm.

12. The sleeve roll belt of claim 11 wherein each second yarn has a diameter between 0.5 mm and 2 mm.

13. The sleeve roll belt of claim 1 wherein each first yarn has a diameter between 0.5 mm and 10 mm.

14. The sleeve roll belt of claim 13 wherein each first yarn has a diameter between 0.5 mm and 2 mm.

15. The sleeve roll belt of claim 1 wherein the sleeve roll belt is configured to stretch elastically at least 1.5% in a travel direction of the sleeve roll belt and is configured to stretch elastically at least 0.1% in a cross direction of the sleeve roll belt.

16. The sleeve roll belt of claim 1 wherein the first yarns and the second yarns form a fabric layer on the outer surface of the elastic body and/or the second yarns are bonded to the first yarns.

17. The sleeve roll belt of claim 1 wherein the first yarns are composed of a fiber selected from the group consisting of: polyamide, polyethylene, aromatic polyamide, polyester, polyethylene terephthalate, carbon fibers, and a carbon fiber thermoplastic composite; and wherein the second yarns are composed of a fiber selected from the group consisting of: polyester, polyethylene terephthalate, polyamide, polyethylene, aromatic polyamide, carbon fibers, and a carbon fiber thermoplastic composite.

18. A sleeve roll in a forming section of a paper, board, pulp or tissue machine, comprising:

a support shaft;

a sleeve roll belt mounted about the support shaft forming a closed loop about the support shaft and having an inner surface and an outer surface, wherein the sleeve roll belt comprises:

an elastic body having an outer surface, a neutral axis, and a reinforcing structure, wherein the reinforcing structure comprises:

first yarns arranged to a first direction within the elastic body of the sleeve roll belt, and second yarns arranged to a second direction of the sleeve roll belt;

wherein the second yarns are arranged on the elastic body, such that each second yarn is arranged at a depth away from the outer surface so no portion of the second yarns is more than 2 mm within the elastic body so the neutral axis of the sleeve roll belt is arranged near the outer surface of the elastic body of the sleeve roll belt;

wherein a number of the second yarns is from 140 yarns/m to 620 yarns/m, and/or a number of the first yarns is from 140 yarns/m to 620 yarns/m; and the sleeve roll further comprising:

a curved element mounted to the support shaft for movement to change the curvature of the belt.

19. A method of forming a paper, board, pulp or tissue web with a sleeve roll in a forming section, the method comprising:

mounting a sleeve roll belt about a support shaft to form a closed loop about the support shaft;

wherein the sleeve roll belt has an inner surface and an outer surface, and wherein the sleeve roll belt comprises:

an elastic body having an outer surface, a neutral axis, and a reinforcing structure;

wherein the reinforcing structure comprises:

first yarns arranged to a first direction within the elastic body of the sleeve roll belt, and second yarns arranged to a second direction of the sleeve roll belt;

wherein the second yarns are arranged on the elastic body such that each second yarn is arranged at a depth away from the outer surface so no portion of the second yarns is more than 2 mm within the elastic body so the neutral axis of the sleeve roll belt is arranged near the outer surface of the elastic body of the sleeve roll belt;

wherein a number of the second yarns is from 140 yarns/m to 620 yarns/m, and/or a number of the first yarns is from 140 yarns/m to 620 yarns/m; the method further comprising:

moving a curved element mounted to the support shaft to change the curvature of the sleeve roll belt to form a paper, board, pulp or tissue web.

* * * * *